US010859087B2

(12) United States Patent
Narayanan et al.

(10) Patent No.: US 10,859,087 B2
(45) Date of Patent: Dec. 8, 2020

(54) METHOD FOR PREVENTING SURGE IN A DYNAMIC COMPRESSOR USING ADAPTIVE PREVENTER CONTROL SYSTEM AND ADAPTIVE SAFETY MARGIN

(71) Applicant: Energy Control Technologies, Inc., Urbandale, IA (US)

(72) Inventors: Krishnan Narayanan, Urbandale, IA (US); Paul Reinke, Elkhart, IA (US); Nikhil Dukle, West Des Moines, IA (US)

(73) Assignee: Energy Control Technologies, Inc., Urbandale, IA (US)

( * ) Notice: Subject to any disclaimer, the term of this patent is extended or adjusted under 35 U.S.C. 154(b) by 918 days.

(21) Appl. No.: 14/804,430

(22) Filed: Jul. 21, 2015

(65) Prior Publication Data

US 2015/0322956 A1 Nov. 12, 2015

Related U.S. Application Data

(62) Division of application No. 13/005,601, filed on Jan. 13, 2011, now Pat. No. 9,133,850.

(51) Int. Cl.
*F04D 27/00* (2006.01)
*F04D 27/02* (2006.01)

(52) U.S. Cl.
CPC ..... *F04D 27/001* (2013.01); *F04D 27/0223* (2013.01)

(58) Field of Classification Search
CPC .... F04D 27/001; F04D 27/02; F04D 27/0207; F04D 27/0223
USPC ..... 415/1, 17, 36, 39, 51, 118; 417/42, 417/44.11, 44.1, 22, 53
See application file for complete search history.

(56) References Cited

U.S. PATENT DOCUMENTS

| | | | |
|---|---|---|---|
| 3,606,754 | A | 9/1971 | White |
| 4,142,838 | A | 3/1979 | Staroselsky |
| 4,697,980 | A | 10/1987 | Keyes, IV et al. |
| 4,949,276 | A | 8/1990 | Staroselsky et al. |

(Continued)

FOREIGN PATENT DOCUMENTS

| | | |
|---|---|---|
| EP | 2 042 743 A1 | 4/2009 |
| WO | WO 02/38963 A1 | 5/2002 |

OTHER PUBLICATIONS

European Extended Search Report, "Communication of the Extended Search Report and Search Opinion" by the European Patent Office in Munich, Germany, for European Application No. 12151162.0, dated Dec. 15, 2017, 9 pages.

*Primary Examiner* — Christopher Verdier
(74) *Attorney, Agent, or Firm* — Zarley Law Firm, P.L.C.

(57) ABSTRACT

A method of preventing surge in a dynamic compressor is disclosed. The method includes providing an anti-surge valve having an adjustable opening for increasing the flow through a dynamic compressor. The next step is sensing process conditions in the dynamic control to determine a compressor load variable. A control system estimates a process disturbance model using the compressor load variable. The control system then adjusts a safety margin using a rate limited response and initiates a closed loop response using process feedback based on the process disturbance model. The control system adjusts the opening of the anti-surge valve according to the safety margin and closed loop response.

21 Claims, 4 Drawing Sheets

(56) References Cited

U.S. PATENT DOCUMENTS

| | | | | |
|---|---|---|---|---|
| 5,709,526 | A | 1/1998 | McLeister et al. | |
| 5,745,362 | A | 4/1998 | Hiroi et al. | |
| 5,798,941 | A | 8/1998 | McLeister | |
| 5,879,133 | A | 3/1999 | Mirsky et al. | |
| 5,951,240 | A | 9/1999 | Mirsky et al. | |
| 6,142,229 | A | 11/2000 | Branson, Jr. et al. | |
| 6,494,672 | B1 | 12/2002 | Khots et al. | |
| 6,558,113 | B2 | 5/2003 | Blotenberg | |
| 7,472,541 | B2 | 1/2009 | Takeda et al. | |
| 8,342,794 | B2 | 1/2013 | Staroselsky et al. | |
| 9,133,850 | B2 * | 9/2015 | Narayanan ..... | F04D 27/0223 |
| 2006/0283169 | A1 | 12/2006 | Narayanan et al. | |
| 2009/0274565 | A1 | 11/2009 | White | |
| 2010/0296914 | A1 | 11/2010 | Staroselsky et al. | |

* cited by examiner

METHOD FOR PREVENTING SURGE IN A DYNAMIC COMPRESSOR USING ADAPTIVE PREVENTER CONTROL SYSTEM AND ADAPTIVE SAFETY MARGIN

CROSS REFERENCE TO A RELATED APPLICATION

This application is a division of U.S. Ser. No. 13/005,601 filed Jan. 13, 2011, which issued as U.S. Pat. No. 9,133,850 on Sep. 15, 2015.

BACKGROUND OF THE INVENTION

The present invention is directed toward dynamic compressors. More specifically, the present invention is directed toward a method utilized by a control system within a dynamic compressor in order to provide surge protection for the dynamic compressor.

A typical dynamic compressor has a gas inlet and a gas outlet wherein the compressor is driven by a compressor driver so that the gas, while flowing through the compressor, is compressed. A problem associated with dynamic compressors is the amount of gas flow that is provided at the gas inlet. Specifically, if an insufficient amount of gas flow is provided, a surge within the system occurs causing damage to the compressor. Because of the high price of compressors great care must be taken to ensure that compressors are not damaged.

To minimize damage to compressors as a result of lack of gas flow at the inlet, a recycle or surge control valve is installed around dynamic compressors where the surge control valve opens to divert gas flow from the outlet of the compressor and recycle it to the inlet of the compressor to ensure that there is always sufficient gas flow in the inlet to prevent surges from occurring.

As a result of the need to protect against surge, control systems have been provided to control the operation of the surge control valve. Compressor surge control systems (also known as anti-surge controllers) use a standard PID (Proportional, Integral, Derivative) controller for regulating the surge control valve when flow rate decreases below a predefined set point. The set point for recycling is established based on heuristic rules and operating guidelines typically set as a fixed margin from a surge limit line (or minimum flow set point).

To improve upon this system, some control systems in the prior art employ the use of a fixed and variable set point to adjust the safety margin based on compressor flow rate changes. The problem with these control systems is that the rate of approach to surge is determined based on the derivative of a flow signal that is typically very noisy in field installations. The control system dampens out the noisy signal through the use of passive digital filters rendering the variable set point determination ineffective and impractical in the field. In addition, these control systems are very difficult to tune in the field because these techniques are not self adapting to varying process conditions.

As a result of the above problems one solution has been to present a second set point established from the surge limit line that is considered a minimum set point for recycling and is sometimes referred to as a fast open control line. The fast open control line acts as a safeguard defense to open the surge control valve further and in a quicker manner in order to protect the compressor. Problems exist with this system because again, the set point is determined in heuristic fashion. Typically, in order to initiate the quick response, control systems use open loop methods or alternatively closed loop variable gain methods to increase the controller gain to initiate quick response. Alternatively, some controllers employ the use of derivative based open loop valve jumps to quickly open the recycle valve when the compressor operating point crosses the fast open control line.

The problem with open loop control response is that an open loop control response is difficult to set up in the field. Moreover, with the degradation of the control elements such as valves or non linearity in process dynamics with changing plant demand, the open loop control parameters need to be retested frequently to match the operating process characteristics. This renders the compressor system performance less than optimum. A direct result of this is decrease in process efficiency; process instability; and even compressor damage from surge and process shutdown.

For control systems with closed loop fast response using variable gain method, it is very difficult to establish the control loop tuning in the field. In addition, this method can make the control system ineffective or even unstable.

For control systems that use derivative based open loop control response the challenges come from noisy flow signals used to characterize response. In these systems the control system dampens out noisy signals through the use of passive digital filters thus rendering the open loop derivative response determination ineffective and impractical to tune in the field.

Control systems based on closed loop rate limiting of the surge variable such as U.S. Pat. No. 5,798,941 suffer from the aspect of using a noisy derivative of flow signal as a process variable to determine quick valve opening. In addition, another problem is that establishing the rate set point for optimum control response is very difficult for a field engineer. Further, tuning a prior art control system in the field also is extremely challenging because the known prior art techniques are not self adapting to changes in field conditions and instead require high level of expertise in the field.

Thus, a principal object of the present invention is to provide a control system and method for providing improved protection for a dynamic compressor.

Yet another object of the present invention is to provide an adaptive safety margin determination based on process disturbance modeling using a compressor load variable.

Another object of the present invention is to provide an adaptive surge preventer control system for a turbo compressor.

These and other objects, features and advantages will become apparent from the specification and claims.

BRIEF SUMMARY OF THE INVENTION

A method for preventing surge in a dynamic compressor using a control system is provided. The method includes providing a surge valve having an adjustable opening for increasing the flow through a dynamic compressor. Processed conditions are sensed in the dynamic control to determine a compressor load variable. Using the compressor load variable a process disturbance model is estimated. Then, based on the process disturbance model estimation, a safety margin is adjusted using a rate limited response and/or a closed loop response using process feedback is initiated. The opening of the anti-surge valve is then adjusted according to the safety margin and closed loop response.

DETAILED DESCRIPTION OF THE PREFERRED EMBODIMENT

Figure 1:
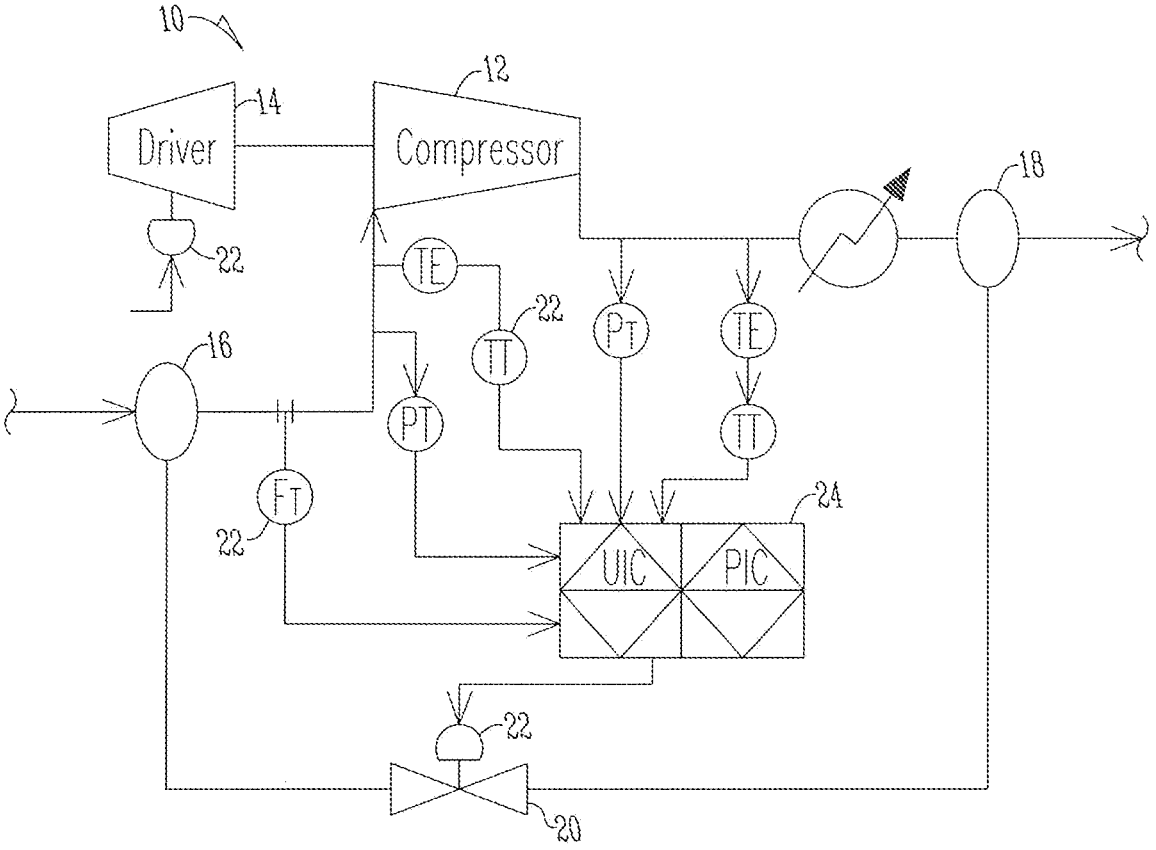
FIG. 1 is a schematic diagram of a dynamic compressor.

FIG. 1 shows a dynamic compressor 10 that includes a compressor 12 that is driven by a compressor driver 14. The compressor driver is of any type including a motor, gas turbine, steam turbine or the like. The compressor 12 has a gas inlet 16 and a gas outlet 18 wherein gas flows through the compressor 12 to be compressed. A surge or recycle valve 20 is fluidly connected between the gas inlet 16 and gas outlet 18 so that when the surge valve 20 opens a fluid flow path exists to convey gas from the gas outlet 18 to the gas inlet 16. A plurality of sensors 22 including pressure sensors, temperature sensors, flow measurement sensors and the like are placed throughout the dynamic compressor 10 in order to determine processed conditions for the components of the dynamic compressor including the compressor 12, the driver 14, the gas inlet 16, and gas outlet 18 and the surge valve 20. The plurality of sensors 22 are electrically connected to the control system 24 where the control system is in real time communication with all of the components of the dynamic compressor and controls the opening of the surge valve 20.

Control system 24 utilizes the plurality of sensors 22 to determine process conditions so that a compressor load variable can be calculated. The compressor load variable can be determined based on different methods. The compressor load variable can be determined by using the compressor dynamic operating point as a function of surge limit. The compressor load variable also can be determined by calculating the power of the compressor driver 14 or the rotating speed of the compressor driver 14. The compressor load variable can also be determined by a system process variable such as header pressure or header flow of the compressor 12 connected in a compression network. A final way of determining the compressor load variable is through mathematical modeling of the compressor 12, the driver 14 or the associated process. Specifically, the compressor load variable is determined using any of these or a combination.

The control system 24, after determining the compressor load variable, estimates a process disturbance model using one of several methods. The first is to take a digital derivative of the compressor load variable. The second is to take a delayed response of the compressor load variable. The third is to utilize filter response of the compressor load variable. The fourth is to utilize a surge model response of the compressor load variable. Once a process disturbance model is estimated a safety margin can be adjusted using a rate limited response of the process disturbance that is obtained and a closed loop response using process feedback can be initiated.

Figure 3:
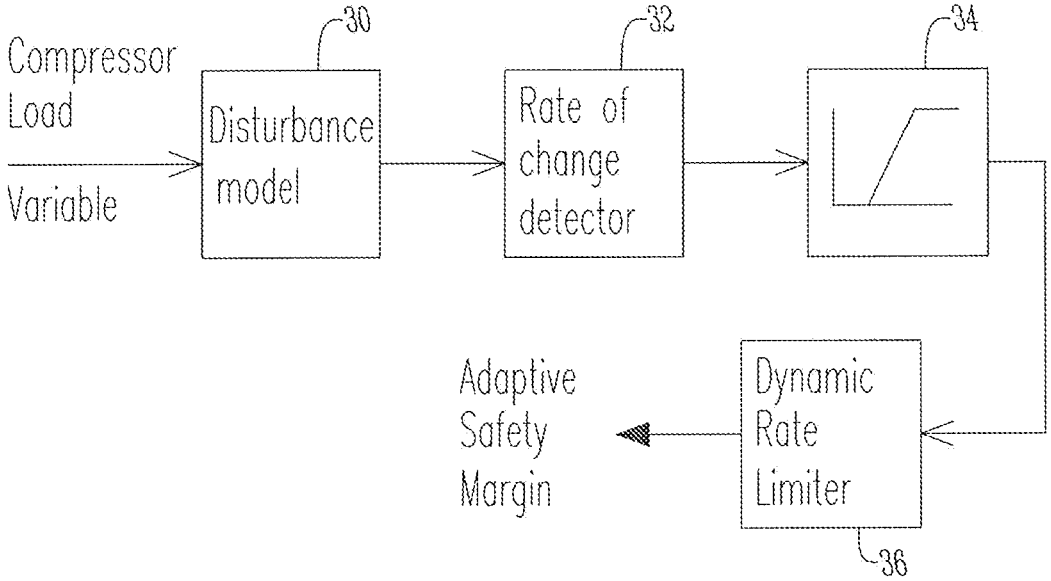
FIG. 3 is a block diagram of a surge adapter response of a control system of a dynamic compressor.
Figure 4:
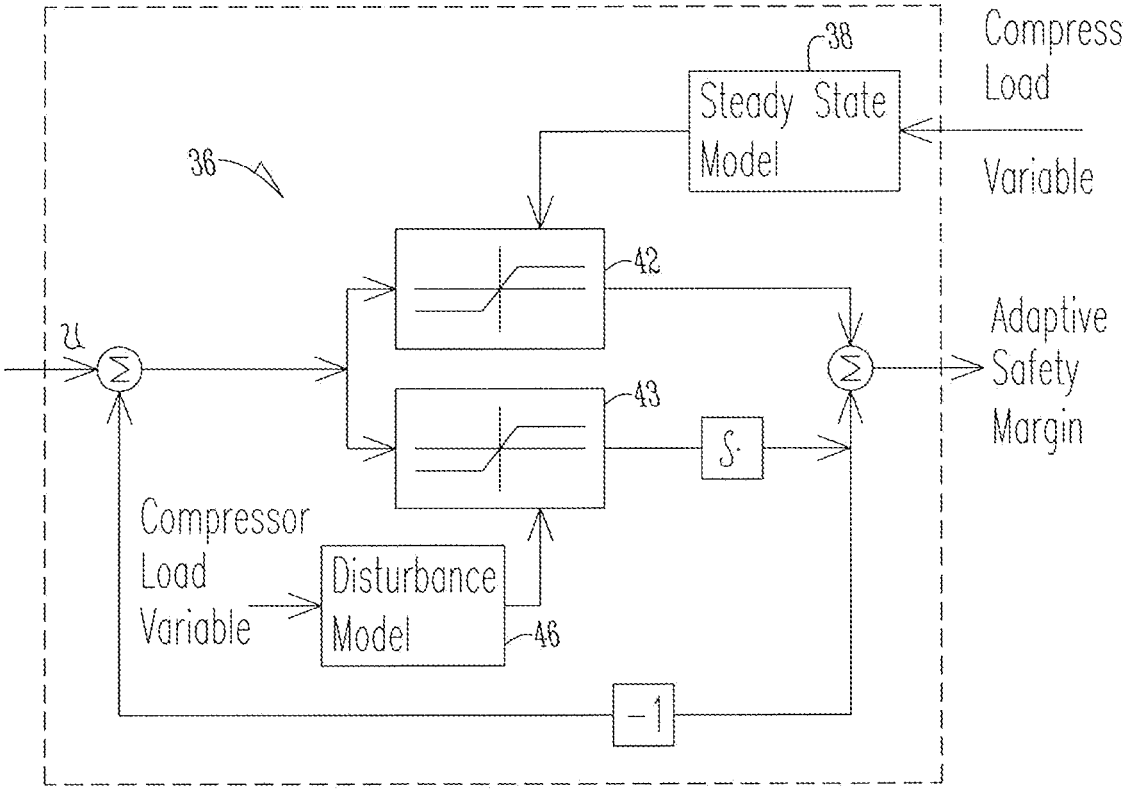
FIG. 4 is a block diagram of a surge adapter response of a control system of a dynamic compressor using a dynamic rate limiter.

FIG. 3 shows an adaptive set point calculation by the control system 24 utilized to determine an adaptive safety margin. The compressor load variable is inputted into a digital filtering disturbance model 30. After the process disturbance model is determined the control system 24 then utilizes a rate of change detector 32 to provide a signal 34 of a safety margin that is then presented to a model based dynamic rate limiter 36 in order to differentiate steady state response from process disturbance upsets. FIG. 4 shows an example of a dynamic rate limiter 36 that uses a steady state model 38 in combination with a disturbance model 46 to provide adaptive set points 42 and 43 in order to arrive at an adaptive safety margin.

Figure 5:
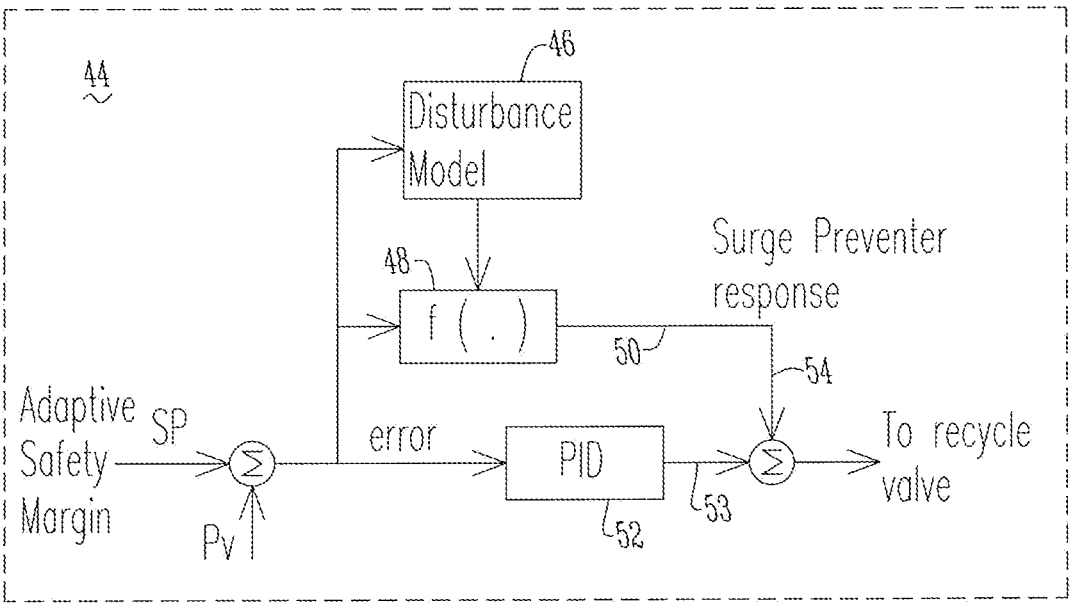
FIG. 5 is a block diagram of a surge preventer and adaptor control system of a dynamic compressor.
Figure 6:
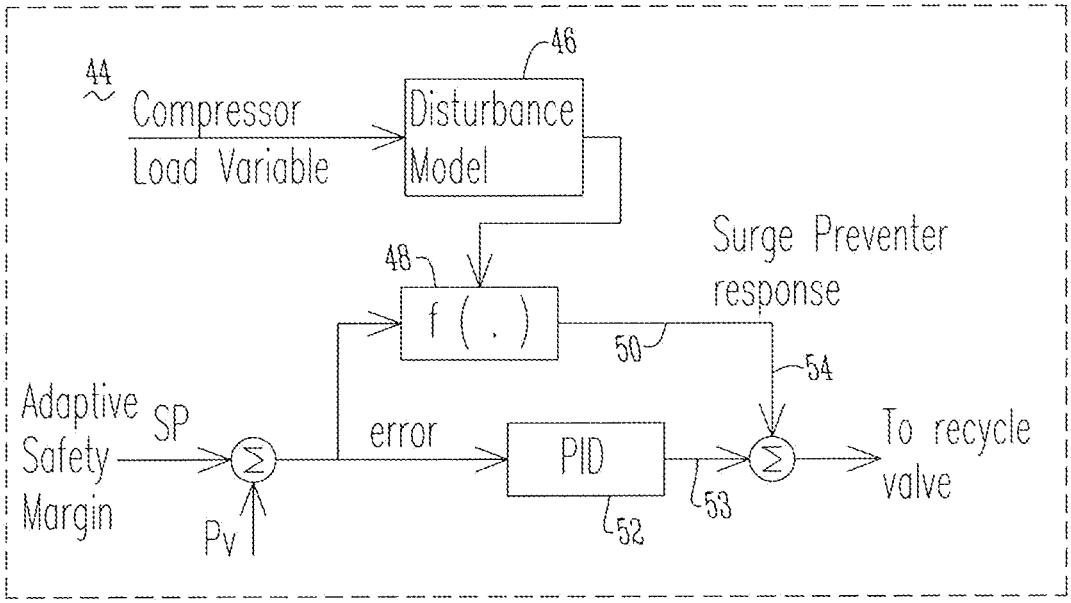
FIG. 6 is a block diagram of an alternative surge preventer and adaptor control system on a dynamic compressor.

FIG. 5 shows an adaptive closed loop surge preventer response process 44 that based on the distance of compressor operating point from the surge-line provides an adaptive closed loop fast response. A process disturbance dynamic model with provisions for differentiating steady state response from process disturbance upsets adjusts the closed loop response further in response to disturbance model output. In one embodiment the distance of compressor operating point to surge line is communicated to a system function 48 to send a response signal 50 that is considered an adaptive surge preventer response signal. En another embodiment for process 44, as shown in FIG. 6, the compressor load variable is inputted into a disturbance model 46 in order to estimate a process disturbance model response. The process disturbance model output is then communicated to a system function 48 to send a response signal 50, that is considered an adaptive surge preventer response signal in another embodiment. Simultaneously the surge controller 52 sends a signal 53 to be summed with the response signal 50 at summation point 54 before the signal goes to the surge valve 20.

Figure 2:
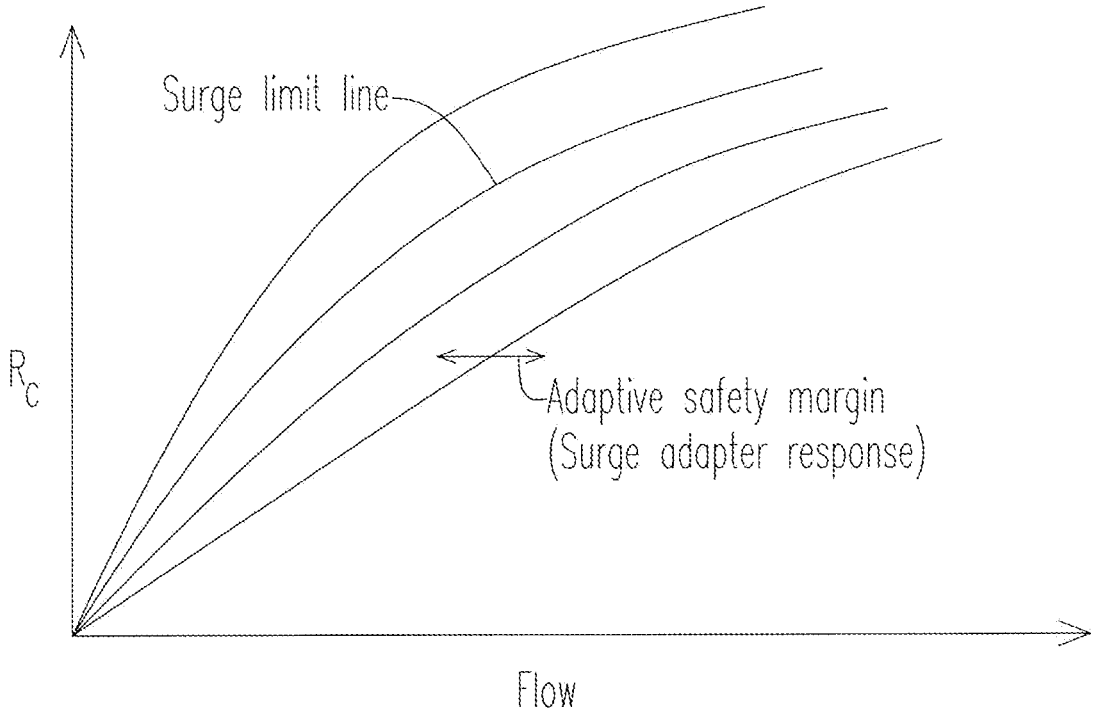
FIG. 2 is a graph showing flow versus pressure ratio to determine a surge limit line.

Thus, upon crossing of a predetermined second set point such as a surge preventer control line as shown in FIG. 2 the control system 24 initiates the closed loop adaptive surge preventer response based on a compressor load feed back variable. In this manner, the method is self adaptive because a compressor feedback variable is used to determine the size of the response going forward in time.

Thus, provided is a dynamic compressor 10 that utilizes a control system 24 that provides a method of adjusting a recycle valve 20 that improves upon the state of the art. Specifically, by determining an adaptive safety margin based upon a compressor load variable to provide a process disturbance model, improved control of the surge valve 20 and protection of the dynamic compressor 10 is provided. Additionally, by using an online determination of parameters based on steady state and dynamic change of compressor load variable measurements an adaptive safety margin rate is utilized thus providing an improved functioning over the prior art. Further, by utilizing the process disturbance model, process feedback is used to determine the size of the response of the control system 24 going forward instead of relying on heuristic open loop jumps as a function of time or gain Changes in proportion to control loop error. Therefore, an adaptive closed loop fast response comes from an online self compensation or self correction of the surge valve action as a result of the steady state and dynamic model of compressor load variable measurements improving upon the state of the art. Thus, at the very least all of the stated objectives have been met.

It will be appreciated by those skilled in the art that other various modifications could be made to the device without departing from the spirit and scope of this invention. All such modifications and changes fall within the scope of the claims and are intended to be covered thereby.

What is claimed is:

1. A method of preventing surge in a dynamic compressor, the method comprising the steps of:

providing a surge valve having an adjustable opening for increasing a flow through the dynamic compressor;

sensing process conditions in the dynamic compressor to determine a compressor load variable;

estimating a process disturbance model using the compressor load variable using a digital derivative of the compressor load variable;

adjusting a safety margin based on the process disturbance model;

initiating a closed loop control response to open the surge valve based on the process disturbance model; and adjusting the opening of the surge valve according to the safety margin.

2. The method of claim 1 wherein the compressor load variable is determined based on a compressor dynamic operating point as a function of a surge limit line.

3. The method of claim 1 wherein the compressor load variable is determined based on compressor driver power.

4. The method of claim 3 wherein the compressor driver is selected from the group consisting of a motor, a steam turbine and a gas turbine.

5. The method of claim 1 wherein the compressor load variable is determined based on compressor driver rotating speed.

6. The method of claim 1 wherein the compressor load variable is determined based on a system process variable.

7. The method of claim 6 wherein the system process variable is a header pressure or flow of a process associated with the compressor.

8. The method of claim 1 wherein the compressor load variable is determined based on mathematical modeling of a system component or process.

9. The method of claim 1 wherein the compressor load variable is a flow of the compressor.

10. The method of claim 1 wherein the compressor load variable is a temperature measurement associated with the compressor.

11. The method of claim 1 wherein the compressor load variable is a pressure measurement associated with the compressor.

12. The method of claim 1 wherein the compressor load variable is a distance of a compressor operating point from a surge limit line.

13. The method of claim 1 wherein the compressor load variable is a power of the compressor driver.

14. The method of claim 1 wherein the compressor load variable is a speed of the compressor.

15. The method of claim 1 further comprising the step of differentiating a steady state response from process disturbance upsets.

16. The method of claim 1 wherein the safety margin is adjusted using a rate limited response based on the process disturbance model.

17. The method of claim 1 further comprising the step of increasing the safety margin based on an increase in response of the process disturbance model.

18. The method of claim 17 further comprising the step of resetting the safety margin based on a rate limited response to a decrease in response of the process disturbance model.

19. The method of claim 18 wherein the decrease in response of the process disturbance model corresponds to a positive rate of approach of a compressor dynamic operating point to a surge limit line.

20. The method of claim 17 wherein the increase in response of the process disturbance model corresponds to a negative rate of approach of a compressor dynamic operating point to a surge limit line.

21. The method of claim 1 wherein the surge valve is opened whenever a distance of a compressor dynamic operating point from a surge limit line is less than the safety margin.

* * * * *